US006734614B1

(12) United States Patent
Tops et al.

(10) Patent No.: US 6,734,614 B1
(45) Date of Patent: May 11, 2004

(54) SADDLE-SHAPED DEFLECTION COIL AND WINDING METHOD

(75) Inventors: Martinus J. Tops, Eindhoven (NL); Nicolaas J. L. Berghs, Eindhoven (NL)

(73) Assignee: Koninklijke Philips Electronics N.V., Eindhoven (NL)

( * ) Notice: Subject to any disclaimer, the term of this patent is extended or adjusted under 35 U.S.C. 154(b) by 0 days.

(21) Appl. No.: 09/451,269

(22) Filed: Nov. 30, 1999

(30) Foreign Application Priority Data

Dec. 7, 1998 (EP) ..... 98204153

(51) Int. Cl.[7] ..... H01J 29/70
(52) U.S. Cl. ..... 313/440; 335/213
(58) Field of Search ..... 313/440, 442, 313/421, 433; 335/210, 213

(56) References Cited

U.S. PATENT DOCUMENTS 2,939,978 A * 6/1960 Irvine et al. ..... 315/399
3,588,566 A * 6/1971 Barbin ..... 335/213
4,078,301 A * 3/1978 Renders et al. ..... 29/605
4,152,685 A * 5/1979 Renders et al. ..... 335/213
4,242,612 A * 12/1980 Heijnemans et al. ..... 313/421
4,445,101 A * 4/1984 Kobayashi et al. ..... 335/210
4,882,521 A * 11/1989 Arimoto ..... 313/440
5,001,390 A * 3/1991 Vink et al. ..... 313/440
5,013,964 A * 5/1991 Vink et al. ..... 313/440
5,446,432 A * 8/1995 Ikeuchi ..... 335/213
5,841,226 A * 11/1998 Hichiwa et al. ..... 313/565
5,859,495 A * 1/1999 Honda et al. ..... 313/440
6,100,779 A * 8/2000 Luard et al. ..... 335/210

* cited by examiner

*Primary Examiner*—Vip Patel
*Assistant Examiner*—Glenn Zimmerman

(57) ABSTRACT

A saddle-shaped deflection coil (21) for a cathode ray tube has a beginning (22) of a current-supply wire which is largely detached from a flange (17) of the deflection coil, which flange does not exhibit an impression of the beginning of the current-supply wire. The deflection coil is wound in a manner such that, after winding and baking of the coil the beginning does not have to be pulled loose from the flange, as has been customary hitherto.

6 Claims, 5 Drawing Sheets

SADDLE-SHAPED DEFLECTION COIL AND WINDING METHOD

BACKGROUND OF THE INVENTION

1. Field of the Invention

The invention relates to a cathode ray tube with a deflection unit comprising a saddle-shaped deflection coil with a flange, said deflection coil flaring out in a fan-shaped manner from a rear end to a front end.

The invention also relates to a deflection unit for a cathode ray tube.

The invention further relates to a method of manufacturing a saddle-shaped deflection coil of a deflection unit for a cathode ray tube.

2. Description of the Related Art

Cathode ray tubes of the type mentioned in the opening paragraph are well-known and are used, inter alia, for and in television receivers and computer monitors.

Customarily, a set of saddle-shaped line deflection coils and a set of saddle-shaped frame deflection coils or a set of frame deflection coils which are toroidally wound on a core, are combined into an electromagnetic deflection unit. The nominal design of the coils may be such that, for example, specific requirements relating to the geometry of a raster scanned by means of the deflection unit on the display screen of a display tribe and/or requirements relating to the convergence of the electron beams on the display screen are met. The coils are wound on a winding machine and include current-supply wires and a beginning of these current-supply wires. The current-supply wires are wound in a winding machine so as to obtain the shape of a coil, and are subsequently baked, in which baking process the current-supply wires are bonded together. The aim is to reduce the time necessary to manufacture a coil and/or to reduce rejects.

SUMMARY OF THE INVENTION

To achieve this, the deflection coil in accordance with the invention is characterized in that the beginning of the current-supply wires is largely detached from the flange, which flange does not exhibit an impression of the beginning of the current-supply wires at the location where said beginning is detached from the flange.

Conventional coils have current-supply wires whose beginning, in the manufacturing process, lies against the flange and is adhered to the flange. However, this has the disadvantage that, in operation, the beginning of the current-supply wires is in the vicinity of current-supply wires which are at a much higher or much lower voltage. This may cause flashover. To preclude this, said beginning is largely pulled loose from the flange after the manufacture of the coil. However, in conventional coils said beginning has left an impression in the flange, which adversely affects the fields generated by the coil. In the cathode ray tube in accordance with the invention, this impression is absent, which causes the quality to be improved and, in particular, reduces the spread in quality. It is also important that the beginning is no longer pulled loose, so that the risk of damage to the insulation layers on current-supply wires, and hence the risk of rejects, is reduced. In addition, the deflection unit can be manufactured more rapidly, resulting in a saving of costs.

These and other aspects of the invention will be apparent from and elucidated with reference to the embodiment(s) described hereinafter.

DETAILED DESCRIPTION OF THE INVENTION

Figure 1:
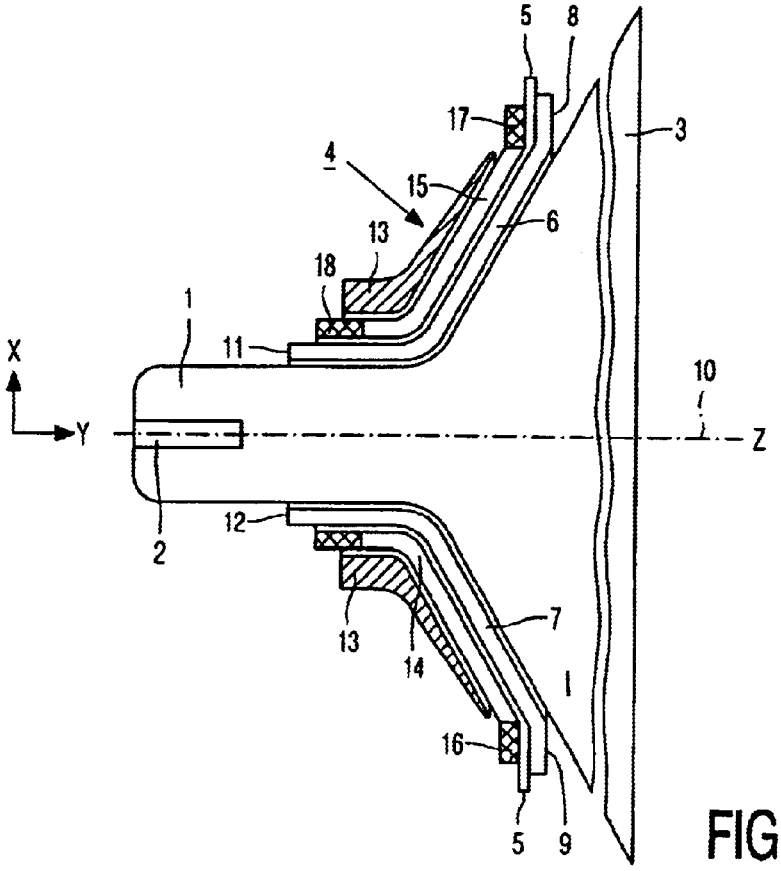
FIG. 1 Prior Art
FIG. 1 is a diagrammatic, longitudinal sectional view of a part of a display tube comprising a deflection unit.

FIG. 1 shows a color display tube 1 comprising an electron gun system 2 for generating three electron beams which are directed towards a display screen 3 comprising a repetitive pattern of red, green and blue phosphors elements. Between the electron gun system 2 and the display screen 3, an electromagnetic deflection system 4 is arranged coaxially with the axis of the tube, around the path of the electron beams. The deflection system 4 includes a funnel-shaped synthetic resin coil support 5 which supports, on its inside, a line deflection coil system 6, 7 for deflecting the electron beams generated by the electron gun system 3 in a horizontal direction. The fan-shaped line deflection coils 6, 7 are of the saddle-type and comprise, at their widest end, a front flange 8, 9 which is predominantly situated in a plane which encloses an angle with the display tube axis 10. At their narrowest end, the coils 6, 7 have packets of connection wires 11, 12 which interconnect the longitudinal flange portions of each of the coils 6, 7, and are provided on the surface of the display tube 1. Thus, the coils 6, 7 shown are of the type having a "horizontal" rear flange and a "vertical" front flange. They may alternatively be of the type having a "vertical" rear flange and a "vertical" front flange or of the type having a "horizontal" rear flange and a "horizontal" front flange.

In this case, the coil support 5 supports, at its outside, two saddle-shaped deflection coils 14, 15 for deflecting electron beams generated by the electron gun system 3 in the vertical direction. A ferromagnetic ring core 13 surrounds both coil sets. In the case shown, the frame deflection coils are of the type having a vertical front flange 16, 17 and a horizontal rear flange. They may alternatively be of the type having a vertical rear flange and a horizontal front flange, or of the type having a horizontal rear flange and a horizontal front flange.

Figure 2:
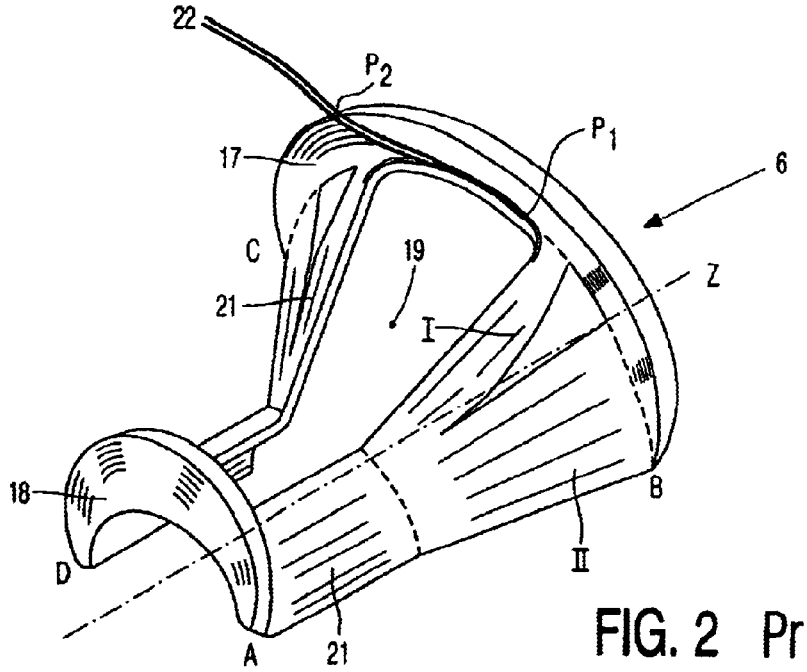
FIG. 2 Prior Art
FIG. 2 is a perspective view of a conventional saddle-shaped deflection coil.

FIG. 2 is a perspective view of a conventional line deflection coil 6. This coil is composed of a number of windings of, for example, copper wire and has a rear end portion 18 and a front end portion 17 between which two flange portions 21 extend on either side of a window 19. As shown in the Figure, in this case, the front end portion 17 and the rear end portion 18 are bent "upwards". Within the scope of the invention, the term "flange" is not to be interpreted in a limiting sense. As shown in FIG. 2, the flange 17 may extend in a direction transverse to the z-direction and hence be bent "straight up" with respect to the portions 21. However, the flange may alternatively extend along the circumference of the tube. This does not always have to be the case for the rearmost end portion 18. All these possible embodiments fall under the term "saddle-shaped deflection coils". The coil 6 widens from the back to the front in a fan-shaped manner, so that it is adapted to the funnel shape of the part 5 of the display tube.

Each of the flange portions 21 may be provided, for example, in the widening (cup-shaped) portion, but possibly also in the cylindrical (neck) portion, with a number of openings which serve to form a number of sections. As shown in the Figure, the deflection coil shown by way of example has, in the cup-shaped portion, a division in a first section I and a second section II. Each winding of the second section surrounds the windings of the first section which are situated more towards the interior (closer to the window 19). By choosing the number, the location and the shape of the openings I, II near the front most end, as well as the number of windings in each one of the sections, a designer can influence the nominal distribution of the magnetic flux generated in the active portions 21. FIG. 2 also shows how a beginning of a current-supply wire (or the beginning of current-supply wires, as a deflection coil is often wound with a plurality of wires at the same time) 22 lies against flange 17. This is an example. The beginning 22 may also lie against the side of flange 18 which is not visible in this Figure. If, within the scope of the invention, the "beginning" of a current-supply wire is mentioned, then this is to be taken to mean the portion of the current-supply wire or current-supply wires which in technical terms is also referred to as the "start lead-out".

Figure 3:
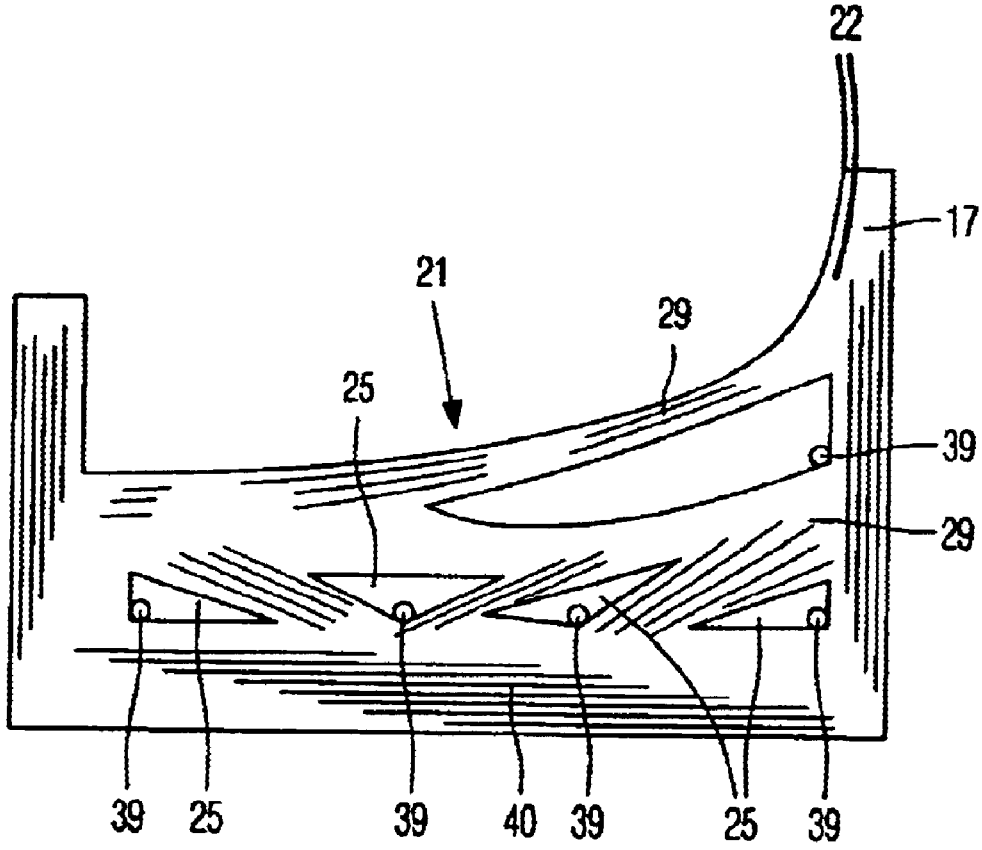
FIG. 3 Prior Art
FIG. 3 is a side view of a conventional deflection unit.

FIG. 3 shows a side view of a conventional deflection unit. As shown in FIG. 3, the deflection unit comprises a flange 17, flange portions 21 and a beginning of the current-supply wires 22. The Figure also diagrammatically shows that the flange portions 21 may include a number of openings 25 and a straight portion 40 as well as a number of oblique portions 29. The position of pins 39 is diagrammatically shown. During winding the coil, the current-supply wires are wound around the pins. The openings 25 can be made by using pins 39 during the winding operation. The beginning 22 is the part of the current-supply wire, or current-supply wires if a plurality of current-supply wires are simultaneously wound, with which the winding process starts. The windings of the flange 17 are and will be wound around the beginning 22. The current-supply wires are provided with an adhesive layer. After winding the adhesive layer, the temperature of the coil is increased, thus causing the current-supply wires to be bonded together. In the conventional deflection units, this means that the current-supply wire 22 is adhered to the flange from point P1 to point P2 (see FIG. 2). However, this has a number of drawbacks. First, the beginning 22 leaves an impression in the flange 17. A groove is formed in the flange 17 at the location where the beginning 22 is adhered to the flange. This means that the windings of flange 17 are not located where they should be according to the design. In addition, in operation, an electric current is passed through the current-supply wires to generate a magnetic field. This leads to voltage differences between parts of the deflection coils. The beginning 22 is situated close to parts of flange 17 which, in operation, are at substantially different voltages. This is the case, in particular, in the vicinity of point P2. This may lead to flashover. To preclude flashover, in conventional deflection units, the beginning 22 is pulled loose almost up to point P1. However, this pulling-loose may cause damage to the insulation layer of the current-supply wires, which increases the risk of rejects. In addition, a current-supply wire may break or the beginning 22 may be pulled loose over a greater distance than planned and desired.

Figure 4A:
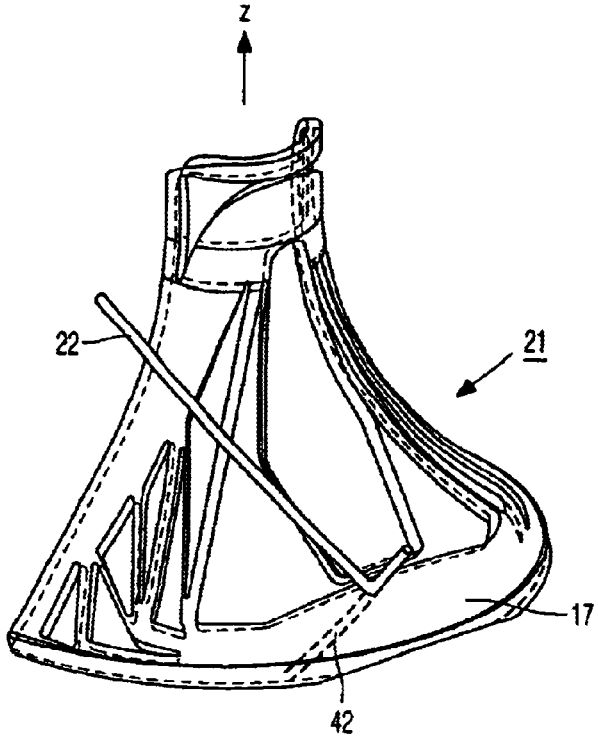
FIG. 4A Prior Art
FIG. 4A is a perspective view of a conventional deflection coil.
Figure 4B:
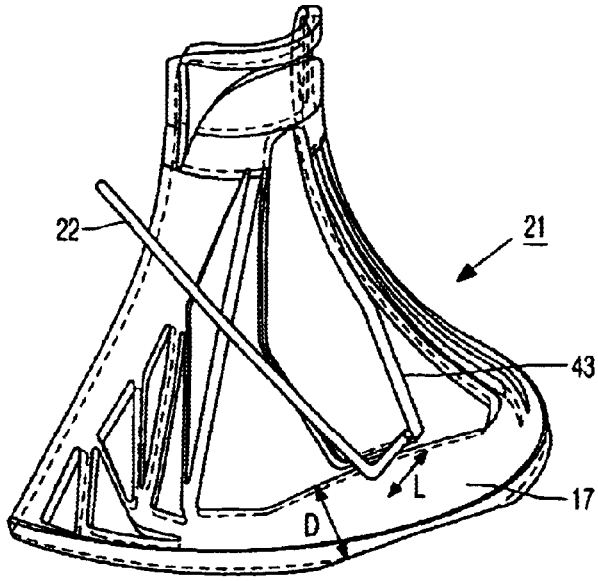
FIG. 4B is a perspective view of a deflection coil according to the invention.

FIGS. 4A and 4B show a detail of a conventional deflection unit and of a deflection unit in accordance with the invention, respectively. Flange 17 shows a groove 42 which corresponds to the position occupied by the beginning 22 of the current-supply wire or wires during winding. This groove is shallow but nevertheless causes an asymmetry in the windings of flange 17. The insulation layer in the groove 42 is damaged at the location where the beginning 22 is pulled loose from the flange 17. FIG. 4B shows a detail of a deflection unit in accordance with the invention, which deflection unit does not have a groove 42 and hence an undamaged insulation layer. The shape of the flange 17 is better defined, the flange 17 exhibits no asymmetry and the flange 17 is generally less damaged. It is noted that, in FIGS. 4A and 4B, the flange 17 extends at an angle with respect to the z-axis, which is smaller than 90 degrees. Thus, within the scope of the invention, the flange 17 does not have to extend at right angles to the z-axis. The term "flange" more generally refers to the parts of the coil which constitute the connection piece between the flange portions 21. Preferably, the beginning 22 of the current-supply wire is attached to the flange over a length L, said length L ranging between D/6 and D/3, where D is the width of the flange at the location of the beginning of the current-supply wire. In the case of a greater length L, there is a relatively great risk of flashover, while a shorter length L leads to a relatively great risk that the beginning is completely detached or unintentionally pulled loose. If the beginning is detached, the bundle of wires 43 may shift, which adversely affects the magnetic field generated, in operation, by the deflection unit.

From FIG. 4B and the above description, it will be clear to those of ordinary skill in the art that the flange 17 has a first flange portion comprising a first plurality of individual wires which are crossed by the length L of the beginning 22 of the current supply wire, the length L therefore being attached to but electrically insulated from this first plurality of individual wires. The flange 17 has a second flange portion extending outwardly from the first flange portion, comprising a second plurality of individual wires which are free from impression by crossing wires, to which the current supply wire is not attached.

Figure 5A:
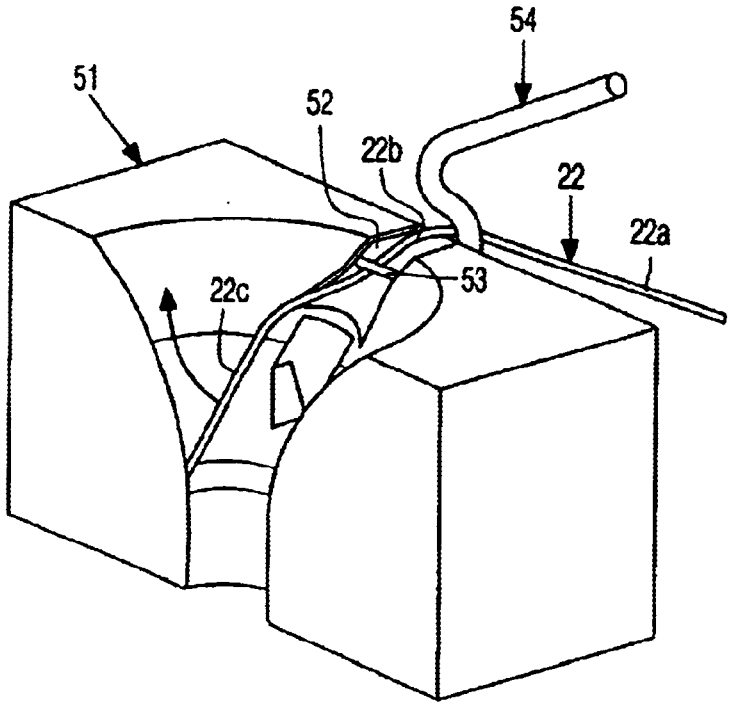
FIGS. 5A and 5B diagrammatically show an embodiment of the method in accordance with the invention.
Figure 5B:
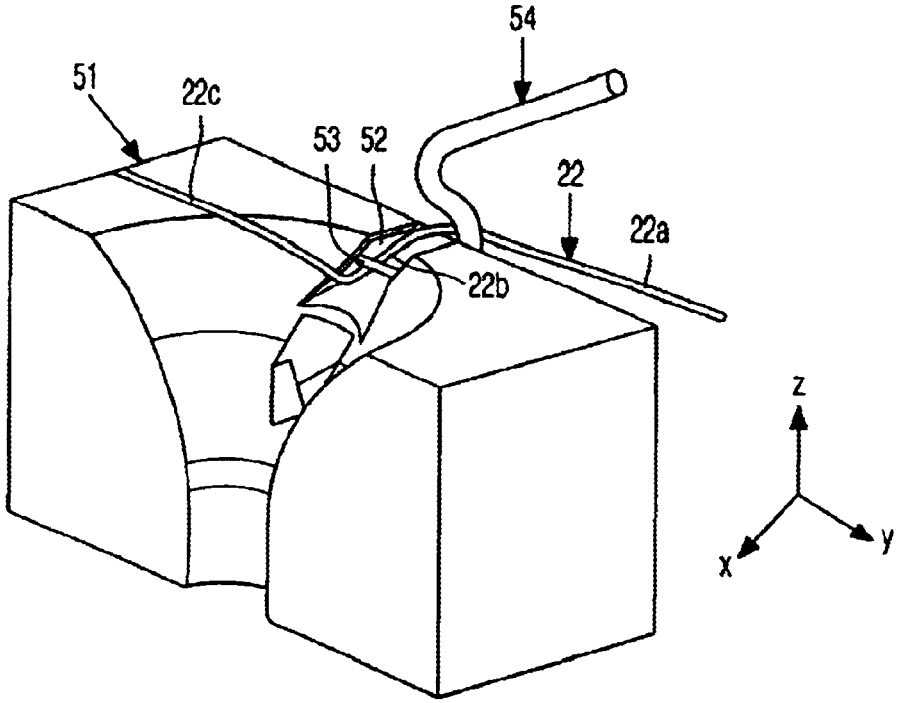

FIGS. 5A and 5B illustrate an embodiment of the method in accordance with the invention. The beginning 22 of the current-supply wire or, if a plurality of wires are wound (which means that a bundle of wires is simultaneously wound), the beginning 22 of the current-supply wires, is wound in a winding former 51. This winding former comprises means for retaining the beginning 22 of the current-supply wires, which means, in this example, include a groove 52 and a pin 53. In this embodiment, at the beginning of the winding operation, the beginning 22 of the current-supply wire is hooked behind a hook 54 and placed in the groove 52, whereafter pin 53 is provided (FIG. 5A). Next, part 22C of the current-supply wires is moved in the direction indicated by an arrow. FIG. 5B shows that after this movement, the beginning of the current-supply wire is placed so as to be S-shaped. Parts 22A and 22C extend, in a broad approximation, parallel to each other, and a part 22B includes an angle with the parts 22A and 22C. After the winding process, part 22C will be secured to the flange. Parts 22B and 22A will remain detached from the flange. Within the scope of the invention, "S-shape" is to be taken to mean any shape which includes a first part which, after winding, is attached to the flange, a second part which includes an angle with the first part so that, after winding, it is detached from the flange, and a third part which includes an angle with the second part. Unlike the angles shown in FIG. 5B, said angles do not have to be more or less coplanar. Part 22A, which in FIG. 5B extends in the y-direction, may, for example, alternatively extend in the z-direction. Unlike the angles shown in FIG. 5B, the angles do not have to be approximately 90 degrees, i.e. more obtuse or more acute angles are possible.

Figure 6A:
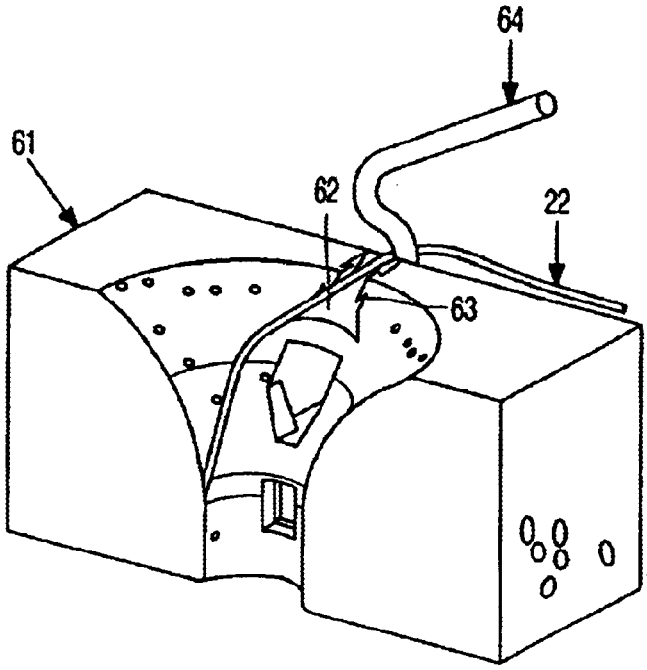
FIGS. 6A and 6B diagrammatically show an embodiment of the method in accordance with the invention.
Figure 6B:
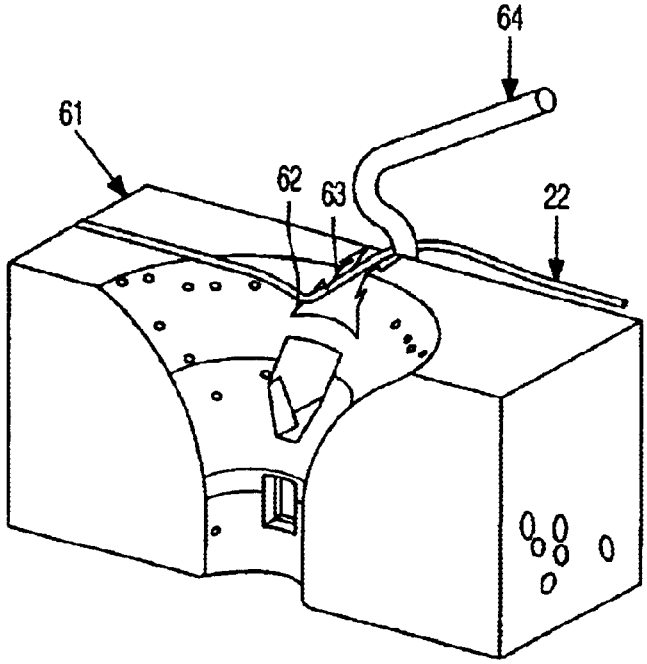

FIGS. 6A and 6B illustrate an embodiment of the method in accordance with the invention. In this embodiment, groove 62 of winding form 61 has an edge, hook or small groove 63, behind which the beginning 22 is retained and concurrently hooked behind a hook 64. This has the advantage that a pin 53 is not necessary.

It will be obvious that within the scope of the invention many variations are possible.

The invention can be summarized as follows:

A saddle-shaped deflection coil (21) for a cathode ray tube has a beginning (22) of a current-supply wire which is largely detached from a flange (17) of the deflection coil, which flange does not exhibit an impression of the beginning of the current-supply wire. The deflection coil is wound in a manner such that, after winding and baking of the coil, the beginning does not have to be pulled loose from the flange, as has been customary hitherto. The fact that the beginning does not have to be pulled loose has the advantages that one process step in the manufacture of the deflection unit can be dispensed with and that the risk of rejects (due to damage to the deflection unit) is reduced.

What is claimed is:

1. A deflection coil for a cathode ray tube, said deflection coil comprising:

a rear flange and a front flange, said rear flange and said front flange each comprising a respective plurality of individual wires forming portions of wire turns, one of said flanges having a first flange portion comprising a first plurality of said individual wires, and said one of said flanges having a second flange portion comprising a second plurality of said individual wires not including said first plurality, a plurality of coil portions fanning out in a fan-shaped manner from the rear flange to the front flange, individual wires of said coil portions being connected respectively to said individual wires forming portions of wire turns in said flanges, and a current supply wire having a first portion extending from one of said individual wires of said coil portions along said first portion of said one of said flanges, arranged so as to cross and be attached to but electrically insulated from said first plurality of said individual wires, and said current supply wire having a second portion free from attachment to said second plurality of said individual wires, characterized in that said second plurality of said individual wires is free from impression by a crossing wire.

2. A deflection coil for a cathode ray tube, said deflection coil comprising:

a rear flange and a front flange, said rear flange and said front flange each comprising a respective plurality of individual wires forming portions of wire turns, one of said flanges having a first flange portion comprising a first plurality of said individual wires, and said one of said flanges having a second flange portion comprising a second plurality of said individual wires not including said first plurality, a plurality of coil portions fanning out in a fan-shaped manner from the rear flange to the front flange, individual wires of said coil portions beings connected respectively to said individual wires forming portions of wire turns in said flanges, and a current supply wire having a first portion extending from one of said individual wires of said coil portions along said first portion of said one of said flanges, arranged so as to cross and be attached to but electrically insulated from said first plurality of said individual wires, and said current supply wire having a second portion free from attachment to said second plurality of said individual wires, characterized in that said one of said flanges has a width D at the location of the beginning of said current supply wire, and said first portion of the current supply wire is attached to said first plurality of said individual wires over a length L, where L is $1/6^{th}$ to $1/3^{rd}$ of said width D.

3. The deflection coil claimed in claim 1, characterized in that said first portion of said current supply wire extends outwardly along said first flange portion to said second portion of said current supply wire, and said second flange portion is disposed outwardly of said first flange portion.

4. The deflection coil claimed in claim 3, characterized in that one of said flanges has a width D at the location of the beginning of said current supply wire, and said first portion of the current supply wire is attached to said first plurality of said individual wires over a length L, where L is $1/6^{th}$ to $1/3^{rd}$ of said width D.

5. The deflection coil claimed in claim 4, characterized in that said second plurality of said individual wires is free from impression by a crossing wire.

6. A deflection coil for a cathode ray tube, said deflection coil comprising:

a rear flange and a front flange, one of said flanges having a width comprising a first flange portion and a second flange portion, said first flange portion comprising a first plurality of individual wires and said second flange portion comprising a second plurality of individual wires not including said first plurality, a plurality of coil portions fanning out in a fan-shaped manner from the rear flange to the front flange, and a current supply wire having a first portion crossing said first flange portion, arranged so as to be attached to but electrically insulated from said first flange portion, and said current supply wire having a second portion free from attachment to said second flange portion, characterized in that said width is a width D at the location of a beginning of said current supply wire, and said first portion of the current supply wire is attached to said first flange portion over a length L, where L is $1/6^{th}$ to $1/3^{rd}$ of said width D.

* * * * *